US009613793B2

(12) United States Patent
Schoenfelder et al.

(10) Patent No.: US 9,613,793 B2
(45) Date of Patent: Apr. 4, 2017

(54) AUTOMOTIVE FRONT LIGHTING LAMP WITH BAFFLE

(71) Applicant: KONINKLIJKE PHILIPS N.V., Eindhoven (NL)

(72) Inventors: Bernd Schoenfelder, Eindhoven (NL); Johannes Gerhard Moeller, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 14/889,600

(22) PCT Filed: May 6, 2014

(86) PCT No.: PCT/EP2014/059157
§ 371 (c)(1),
(2) Date: Nov. 6, 2015

(87) PCT Pub. No.: WO2014/180806
PCT Pub. Date: Nov. 13, 2014

(65) Prior Publication Data

US 2016/0086789 A1 Mar. 24, 2016

(30) Foreign Application Priority Data

May 7, 2013 (EP) ..... 13166754

(51) Int. Cl.
*F21V 1/00* (2006.01)
*H01K 1/26* (2006.01)
(Continued)

(52) U.S. Cl.
CPC ..... *H01K 1/26* (2013.01); *F21S 48/1172* (2013.01); *H01K 9/08* (2013.01)

(58) Field of Classification Search
CPC ..... H01K 1/26; H01K 9/08; F21S 48/1172
(Continued)

(56) References Cited

U.S. PATENT DOCUMENTS 2,912,610 A * 11/1959 Verbeek ..... H01K 1/14 313/115
3,569,693 A * 3/1971 Lindae ..... F21S 48/147 313/113
(Continued)

FOREIGN PATENT DOCUMENTS

CA 566050 11/1958
DE 1224404 9/1966
(Continued)

OTHER PUBLICATIONS

PCT International Search Report, mailed Aug. 26, 2014, International Application No. PCT/EP2014/059157, 8 pages.
(Continued)

*Primary Examiner* — Bryon T Gyllstrom

(57) ABSTRACT

A lamp for automotive vehicle front lighting is described. The lamp 10 comprises a base 12 for mechanical and electrical connection to an automotive headlight 50 and a burner 14 fixed to the base 12. The burner 14 comprises an enclosed transparent vessel 22. A first and a second filament 34, 36 are arranged within the vessel 22. A baffle 40 is arranged proximate to the first filament 34 to shield the second filament 36 from the first filament 34. The baffle 40 is of concave shape and includes a bottom surface 41 and side surfaces 45 terminating in side edges 48. The baffle 40 further includes a front surface 43 arranged between the first and second filaments 34, 36 to shield the second filament 36 from light emitted from the first filament 34. The side edges 48 each comprise a central portion 54 extending, in side view, straight and in parallel to the longitudinal axis X. The straight central portions 54 have an axial length of at least
(Continued)

3.5 mm. An edge height $H_E$ is defined as a distance between the bottom surface 41 and the plane defined between the central portions 54 of the side edges 48. The edge height is more than 2.8 mm.

11 Claims, 3 Drawing Sheets

(51) Int. Cl.
*H01K 9/08* (2006.01)
*F21S 8/10* (2006.01)

(58) Field of Classification Search
USPC ..... 362/509
See application file for complete search history.

(56) References Cited

U.S. PATENT DOCUMENTS 3,646,385 A * 2/1972 Wichert ..... H01K 9/08 313/114
4,385,257 A * 5/1983 Fitzgerald ..... F21S 48/1113 313/113
4,723,198 A * 2/1988 Levin ..... F21S 48/10 362/207
RE32,624 E * 3/1988 Myles ..... F21V 15/04 362/306
2003/0053309 A1* 3/2003 Behr ..... H01K 1/16 362/214
2003/0090905 A1* 5/2003 Uchida ..... B60Q 1/1415 362/465
2008/0050104 A1* 2/2008 Mizukawa ..... H01K 1/16 392/416
2008/0180968 A1* 7/2008 Konishi ..... B60Q 1/1415 362/539
2010/0002458 A1* 1/2010 Tessnow ..... F21S 48/1172 362/516
2010/0039017 A1* 2/2010 Auer ..... H01K 1/18 313/316
2010/0060160 A1* 3/2010 Auer ..... H01K 9/08 313/569

FOREIGN PATENT DOCUMENTS

DE 3616673 11/1987
DE 102006060772 6/2008
DE 102007048387 4/2009
GB 895825 5/1962

OTHER PUBLICATIONS

EP Extended Search Report, mailed Sep. 25, 2013, Application No. 13166754.5-1556, 8 pages.

* cited by examiner

AUTOMOTIVE FRONT LIGHTING LAMP WITH BAFFLE

CROSS-REFERENCE TO RELATED APPLICATIONS

The present application is a §371 application of International Application No. PCT/EP2014/059157 filed on May 6, 2014 and entitled "Automotive front lighting lamp with baffle," which claims the benefit of EP Application No. 13166754.5, filed on May 7, 2013.

FIELD OF THE INVENTION

The invention relates to an electrical lamp, and in particular to a lamp for use in automotive vehicle front lighting. The invention further relates to a vehicle headlight, in particular for a two-wheeled vehicle such as a motorcycle.

BACKGROUND OF THE INVENTION

Automotive headlights, i.e. headlights for use on board of a vehicle, such as e.g. a car, motorcycle, truck or other type of vehicle generally comprise a reflector and, mounted therein, a lamp. Known incandescent lamps, in particular halogen lamps, generally comprise a base and a burner. The base provides mechanical and electrical connection to the automotive headlight, whereas the burner comprises the actual light-emitting element, in particular filament. Light emitted from the filament is reflected by the reflector to form a beam for illumination in front of the vehicle.

Different types of incandescent lamps are known, which comprise one or more filaments arranged within a vessel.

DE 10 2006 060 029 A1 describes a halogen lamp for a vehicle headlight. The halogen lamp comprises a cylindrical lamp vessel and two filaments arranged in parallel to the longitudinal axis of the vessel. Adjacent to a filament, a baffle formed out of molybdenum sheet metal is arranged, which is tub-shaped. The baffle comprises a welding tab, and the adjacent filament is welded to the baffle at the welding tab. The distance between the end of the welding tab and the first end of the filament is between 5.9 and 11.9 mm.

CA566050 describes a lamp with a filament and baffle arrangement. The baffle has a back surface higher than the other portions of the baffle, in particular also higher than the front surface near the second filament. This known baffle is not optimal with respect to the shielding properties, is difficult to produce and the wire connection at the back surface is complicated.

It is an object to propose a lamp with a filament and baffle arrangement well suited for automotive front lighting application, in particular for a symmetric bright/dark cutoff in a beam reflected by a reflector.

SUMMARY OF THE INVENTION

According to an aspect of the invention, a lamp according to claim 1 and a vehicle headlight according to claim 11 are proposed. Dependent claims refer to preferred embodiments.

A lamp according to an aspect of the invention comprises a base for mechanical and electrical connection to an automotive headlight. Electrical contacts may protrude out of the base, in particular from the rear thereof. The base further preferably comprises a positioning ring which serves for mounting the lamp in a reflector of a vehicle headlight in a defined position and orientation. The positioning ring may comprise radial protrusions, which may serve for mechanical fixing, and for exact positioning. It is in particular preferred to provide one reference protrusion to define a radial reference axis R.

The lamp further comprises a burner with a sealed vessel, at least partially transparent, preferably of glass. According to the invention, at least a first and a second filament are arranged within the vessel, provided at a distance from each other. Preferably, the filaments are spaced along the longitudinal axis of the lamp, i.e. the axis extending centrally through the positioning ring and also along the longitudinal axis of the e.g. cylinder-shaped vessel. The central longitudinal axis of the vessel (short: vessel axis) may be identical to the longitudinal axis of the lamp (lamp axis). Preferably, however, there is an offset such that lamp axis and vessel axis run parallel but at a distance.

According to one aspect, a baffle may be arranged proximate to a first filament. As will become apparent in connection with preferred embodiments, the baffle may in particular be arranged to cover the axial range of the first filament, i.e. be arranged in radial directions of the first filament along the whole axial length thereof. Thus, a portion of the light emitted from the first filament, emitted into spatial directions of the proximate baffle, will be shaded by the baffle.

According to an aspect of the invention, the baffle is of concave shape. The baffle includes at least a bottom surface, side surfaces and a front surface. Preferably, the baffle is provided in one piece and made out of correspondingly shaped sheet metal, in particular molybdenum.

The front surface is arranged at a front axial end of the baffle, preferably the end facing towards the base. The front surface is arranged at least partially in between the filaments. Thus, the baffle is effective to shield the second filament from light emitted from the first filament. The baffle thus serves to separate angular ranges illuminated by both filaments from angular ranges illuminated only by the second filament, where light emitted from the first filament is shaded at the baffle. Corresponding portions of the reflector may be shaped to reflect light emitted from the first filament—which may be denoted a low beam filament—into a first beam (low beam, comprising a bright/dark cutoff) and correspondingly reflect light emitted from the second filament (e. g. high-beam filament) into a reflected beam (high beam) without a bright/dark cutoff.

The side surfaces of the baffle, which extend roughly in parallel to the vessel and lamp axes and also the front and back surfaces may be connected to the bottom surface of the preferably bowl-shaped baffle by rounded connecting portions.

The edges of the side surfaces are here referred to as side edges.

According to an aspect of the invention, the side edges have at least a central portion which extends, in a side view, substantially straight and in parallel to the lamp axis.

As the skilled person will appreciate, the shape of the side edges, which is here referred to as substantially straight and parallel to the lamp axis should be understood in side view, or in a projection onto a central symmetry plane, as e. g. shown in the detailed description in FIGS. 2, 3. The central portions referred to here as "substantially straight" may actually be bent as viewed from above; what is referred to in the present context is the straight shape as viewed in the side view/symmetry plane projection. In this view, the shape is represented as straight if the height of the central portion is constant with regard to the plane of the bottom surface.

With regard to the shape of the side edges, the term "straight and in parallel" should be understood to include minor tolerances, such that a slight curvature e. g. at an end of the central portions and also a slight overall inclination relative to the lamp axis may still be possible for a straight and parallel side edge. In particular, such a minimal inclination may be defined between a first measuring point at a distance from the front end of the baffle and a second measuring point defined at a second, greater distance b along the lamp axis. For a parallel orientation, the transversal deviation between the two measuring points should be no more than 0.2 mm, and preferably 0.1 mm or less. The coordinates a, b of the measuring points, for the purposes of determining the straight shape and parallel orientation, may e.g. be defined such that the first measuring point corresponds to the start of the central portions, proximate to the first end of the baffle. The second measuring point b may be taken as a fixed reference point at a distance b=5 mm from the first end along the lamp axis.

Since it is generally preferred that the front surface extends higher than other portions of the baffle, the side edges will generally not (in side view) extend straight and in parallel to the longitudinal axis over their entire axial length. However, according to an aspect of the invention, the side edges comprise such straight and parallel central portions of considerable axial length. This axial length is important for the shape and distribution of the resulting beam pattern.

As will become apparent in connection with preferred embodiments, the first filament will be arranged at a distance from the bottom surface, at least partially above a plane defined between the side edges. (In the present context, relative terms such as "above" or "below" will refer to the generally horizontal mounting position of the lamp within a vehicle headlight, where the baffle is arranged below the first filament. Such terms referring to relative location should be understood as illustrative but certainly do not limit use of the lamp in other orientations.)

Light emitted from the filament towards the baffle will be shielded. Thus, the side edges define the angular ranges of light directions emitted from the first filament, which will either be shaded by the baffle, or which will pass by the baffle to be reflected by the reflector of a vehicle headlight and form a resulting illumination beam.

According to the invention, the dimensions of the baffle and the shape of the side edges is specifically chosen to obtain an optical function, where the illumination provided by the filaments is well seperated, and where an advantageous illumination distribution is obtained.

According to an aspect of the invention, the substantially straight and parallel central portions of the side edges (in side view) are arranged close to the front end of the baffle. Advantageously, the central portions of the side edges start at a distance a of no more than 2.8 mm along the lamp axis from the front end of the baffle. Further preferred, the start of the substantially straight central portions is at 1.4-2.8 mm (along the lamp axis) from the front end, further preferred 1.7-2.5 mm. Thus, in comparison to prior baffle designs, a substantially straight and parallel central portion of the side edges starts at a relatively small distance from the front end of the baffle, and the inclinded portion of the side edges leading up to the front surface of the baffle is minimized. The inventors have recognized that in particular this portion of the baffle is arranged in an optically critical position, and that providing relatively long central portions relatively close to the front end leads to an advantageous light distribution.

Further, the bottom surface is arranged at a distance (edge height) to a plane defined between the central portions of the side edges by more than 2.8 mm.

According to the invention, thus a baffle is provided of increased dimensions as compared to many prior known designs. The edge height is increased to more than 2.8 mm. In further preferred embodiments, the edge height is chosen to be 3.0 mm or more, and particularly preferred 3.3. mm or more.

Further, by arranging the front end of the baffle to shield the second filament from the first filament, a clear separation is achieved between ranges illuminated by the second filament only (e. g. to obtain a high beam) and by ranges illuminated by the first filament (e. g. low beam).

According, to preferred embodiments, the side edges are provided with a relatively long central portion, extending (in side view) substantially straight and in parallel to the lamp axis. Thus, over the axial length of the central portions, which may be at least 3.5 mm, and preferably may be 4 mm or more, particularly preferred even 6 mm or more, relatively long, straight edges (in side view) are provided, separating between shielded and non-shielded angular portions. This is particularly suitable to obtain, after reflection at a vehicle headlight reflector, a resulting beam with a strong bright/dark cutoff, and in particular with a symmetrical, horizontal bright/dark cutoff.

According to a further preferred embodiment, the baffle comprises a flat attachment member located at a back end, opposite to the front end. The flat attachment member may be oriented substantially in parallel to the bottom surface of a baffle and may be arranged in a plane distant from the bottom surface by an attachment member height. According to a preferred aspect, the attachment member height may be less than the edge height, i.e. the central portions of the side edges will be arranged higher (in side view) than the attachment member. For example, the edge height may be at least 0.2 mm greater than the attachment member height, further preferred at least 0.5 mm.

As already explained, the front surface will extend, at least at a centrally arranged tip portion, up to a front height (defined as the distance from the bottom surface to the tip portion) which is generally greater than the edge height. Preferably, the front height is more than 3.5 mm and will preferably be 3.8 mm or more. Particularly preferred, the front height will be at least 4 mm.

In one embodiment, the first filament may be provided as a winding structure of a filament wire wound around a first filament axis. The first filament axis may preferably be oriented in parallel to the lamp axis. Relative arrangement of the first filament and the baffle may be characterized by a first filament distance (defined as distance between—in side view—an upper edge of the first filament and the plane defined by the central portions of the side edges) and by a first axial filament length and its arrangement relative to the axial arrangement of the baffle.

Preferably, the first filament distance will be 0.25-0.75 mm.

As far as axial arrangement is concerned, it is preferred to provide the first axial filament length at least partially extending over the straight central portions of the side edges of the baffle. Preferably, the central portions axially overlap at least 70% of the first axial filament length, further preferred more than 90%, especially preferred more than 95%.

According to one preferred embodiment, the filaments and the baffle may be shaped and arranged symmetrically within the vessel relative to a symmetry plane. In a preferred embodiment, the symmetry plane may be defined by the lamp axis X and by the reference direction R as given by the center of a reference protrusion of the positioning ring. By shaping and arranging the optical elements, i.e. the filaments and the baffle symmetrical to this symmetry plane, the resulting intensity distribution of light emitted from the first filament after reflection at the reflector of a vehicle headlight will also be symmetrical, i.e. comprise a horizontally arranged bright/dark cutoff.

According to a further aspect, a vehicle headlight with a reflector may be equipped with a lamp according to one of the above aspects. In particular, the vehicle headlamp may be a motorcycle headlamp.

These and other aspects of the invention will become apparent from and elucidated with reference to the embodiment described hereinafter.

DETAILED DESCRIPTION OF EMBODIMENTS

Figure 1:
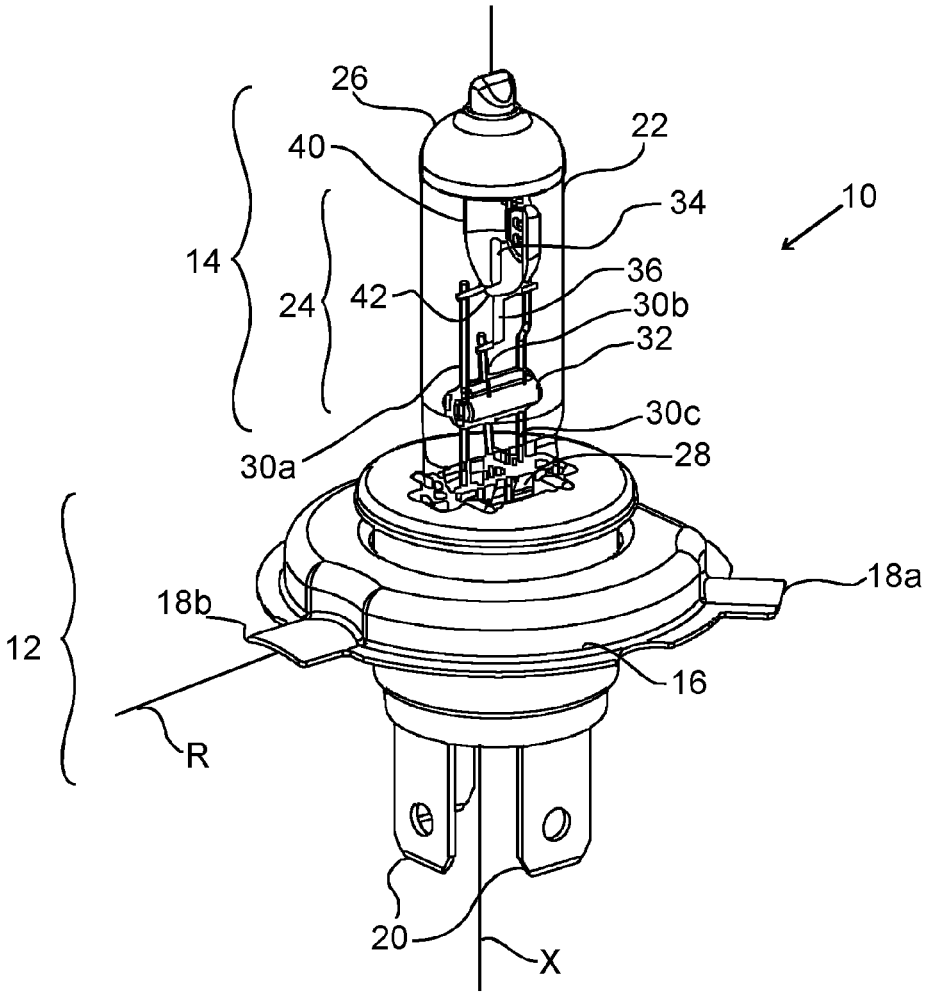
FIG. 1 shows a perspective view of a lamp according to an embodiment of the invention.
Figure 2:
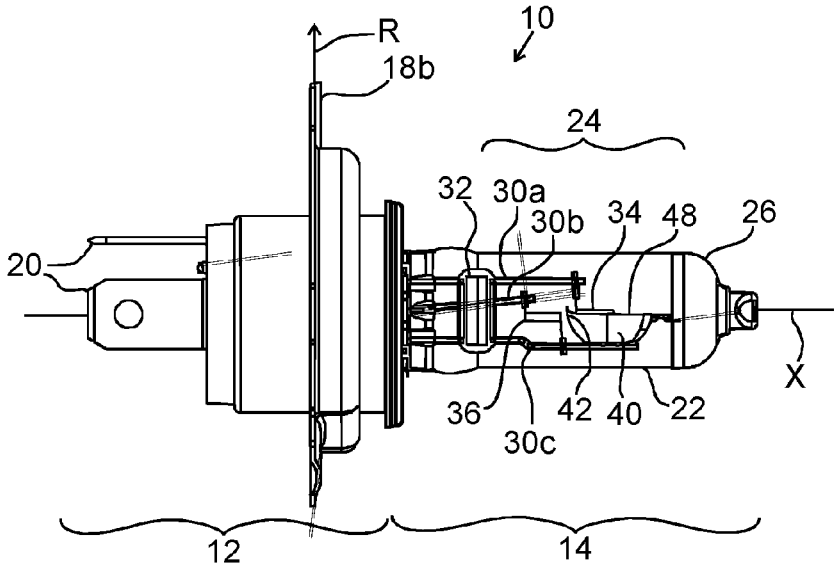
FIG. 2 shows a side view of the lamp of FIG. 1 in the horizontal operating position.

FIGS. 1, 2 show an automotive halogen lamp 10.

The lamp 10 comprises a base 12 and a burner 14 fixed to the base 12.

The base 12 comprises a positioning ring 16 which includes three positioning protrusions 18*a*, 18*b* radially protruding from the base 12 (of which only two are shown in FIG. 1).

Figure 5:
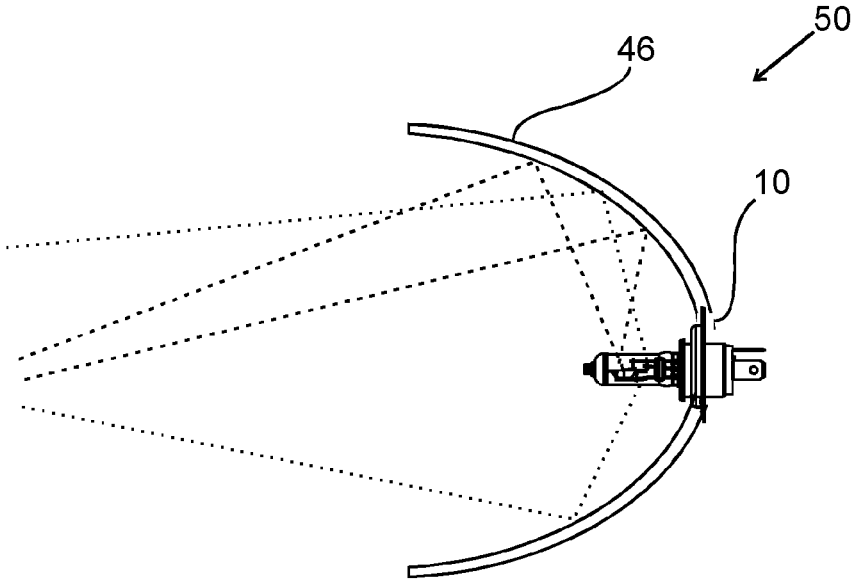
FIG. 5 shows in a schematic representation a vehicle headlight with a lamp according to FIGS. 1-4

The lamp 10 may be fixed to a vehicle headlight so as symbolically shown in FIG. 5 where the exact position is determined by the protrusions 18*a*, 18*b*. The protrusion 18*b* serves as a reference protrusion defining the reference direction R. A reference plane for the mounting position of the lamp 10 in the reflector 46 may be defined by the upper portions of the three positioning protrusions. A lamp axis X may be defined as longitudinal axis of the lamp 10 perpendicular to this reference plane through the center of the positioning ring 16. The radial reference direction R is defined by the center of the reference protrusion 18*b*.

The burner 14 comprises a glass vessel 22 with a central portion 24 of circular cylindrical shape. At the top, the otherwise transparent vessel 22 comprises a coated portion 26 which is opaque. At the bottom, the vessel 22 is sealed in a pinch seal 28, which is fixed to the base 12. The glass vessel 22 is arranged such that its central longitudinal axis (vessel axis) is in parallel to the lamp axis X, but arranged at an offset, i.e. a transversal distance.

Projecting from the pinch seal 28 into the interior of the vessel 22 are three holding wires 30*a*, 30*b*, 30*c*. The holding wires 30*a*, 30*b*, 30*c* are further fixed by a holding bar 32 arranged distant from the pinch seal 28. Further, fixed to the holding wires 30*a*, 30*b*, 30*c* are arranged a first filament 34 (low-beam filament) and a second filament 36 (high-beam filament).

Proximate to the first filament 34, a baffle 40 is arranged. As shown, the baffle is provided to cover the axial extent of the first filament 34 and thus partially shield light emitted from the filament 34 into radial directions. Further, a front portion 42 of the baffle 40 is arranged in between the first and second filaments 34, 36 and therefore serves to shield the filaments 34, 36 from one another.

Figure 3:
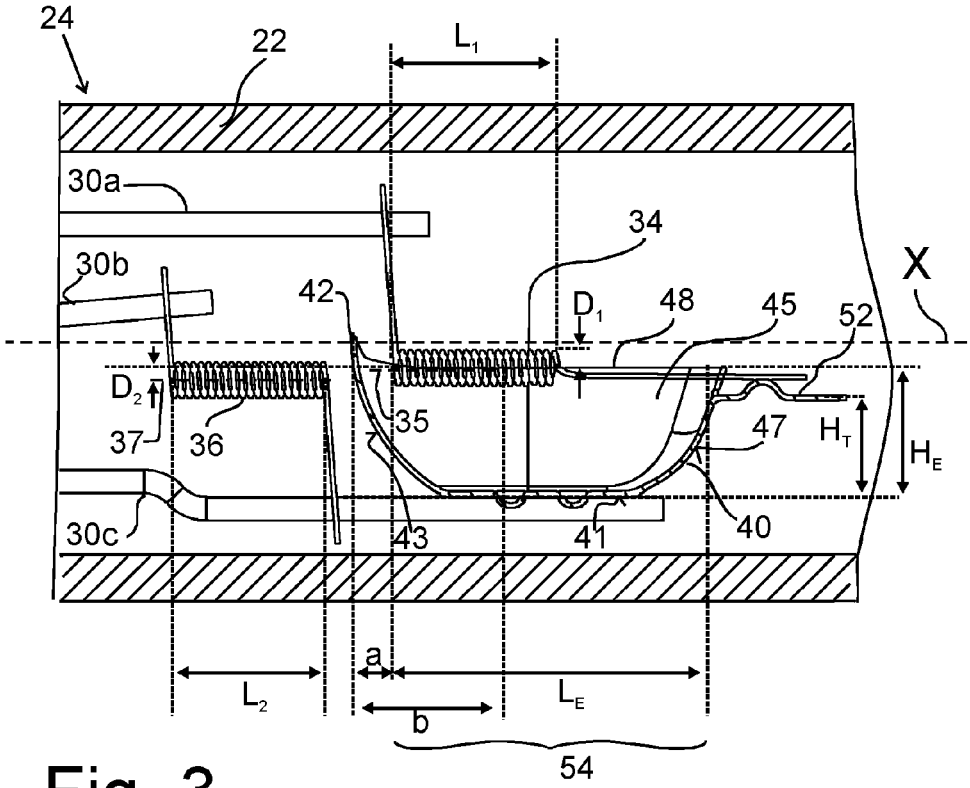
FIG. 3 shows an enlarged sectional view of a portion of the lamp of FIG. 1 with the section taken along line R in FIG. 1.

As also shown in detail in the enlarged sectional view of FIG. 3, the first, low beam filament 34 is connected at one end to a first holding wire 30*a* and at the other end to the baffle 40, which is fixed to the third holding wire 30*c*. The second, high-beam filament 36 is fixed to a second holding wire 30*b* and to the third holding wire 30*c*. By these connections, the filaments 34, 36 are both mechanically held at defined positions within the vessel 22 and are electrically connected to the holding wires 30*a*, 30*b*, 30*c*. The holding wires, in turn, are connected internally within the base 12 to electrical contacts 20 protruding from the lower portion of the base 12. Thus, the filaments 34, 36 are operated by supplying electrical power to the electrical contacts 20.

Figure 4:
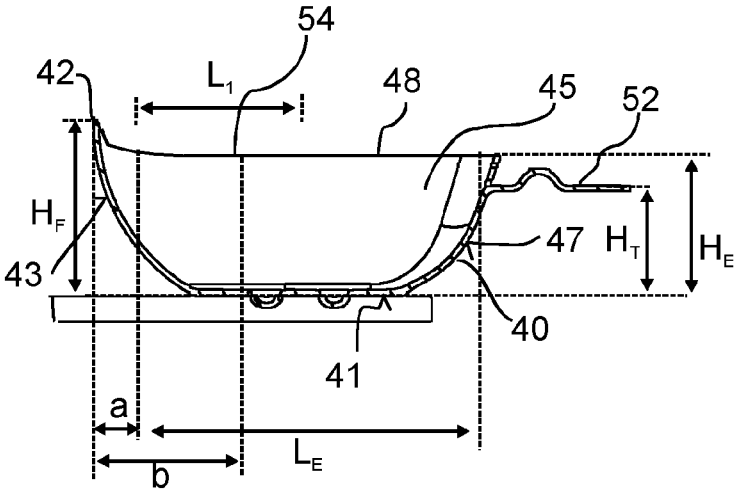
FIG. 4 shows an enlarged sectional view of the baffle of FIGS. 1-3.

FIG. 3 shows an enlarged sectional view of the central, circular-cylindrical portion 24 of the vessel 22, and FIG. 4 shows the baffle 40 without the filaments 34, 36. As shown in FIG. 3, the filaments 34, 36 are each provided as a single winding structure of filament wire wound around a straight filament axis.

In FIG. 3, the filament axis 35 of the first filament 34 and the filament axis 37 of the second filament 36 are arranged in parallel to the longitudinal axis X of the lamp 10.

The first filament 34 has an axial length $L_1$ of 4.2 mm. The axial length $L_2$ of the second filament 36 is 4.0 mm.

The baffle 40 comprises a bottom surface 41 from which a front surface 43, a back surface 47, and side surfaces 45 extend. The side surfaces 45 terminate in side edges 48. At the back surface 47, an attachment tab 52 is integrally formed.

The attachment tab 52 serves to connect the filament wire of the first filament 34 to the baffle 40. It is arranged substantially flat in a plane that is oriented horizontally in FIG. 3 at an attachment height $H_T$ of 2.6 mm above the bottom surface 41.

The front surface 43 extends at a central tip 42 up to a front height $H_F$ of 4.1 mm.

As shown in FIG. 4, the side edges 48 comprise a portion 54, which in a side view of FIG. 2 or in a sectional view of FIG. 3 extend straight and in parallel to the longitudinal axis X of the vessel 22. As the skilled person will appreciate, the portions 54 here referred to as extending "straight" in the view of FIG. 3 will not be straight as viewed from above. Thus, the optical functions and measurements of the straight portions 54 of the side edges 48 in the present description refer to the side view, as e. g. shown in FIGS. 2 and 3.

The central, straight portions 54 extend (in side view) straight and in parallel to the longitudinal axis X, i.e. without a variation in height above the bottom surface 41 over a considerably long distance $L_E$. The distance $L_E$ in the preferred embodiment is 7.2 mm. The straight portions 54 start at the front end 42 of the baffle 40 after a distance a of 2 mm and extend up to the back wall 47.

Compared with prior vessel designs, the distance parameter a is relatively small, i.e. the straight portions 54 start at a very small distance along the lamp axis X from the front end 42 of the baffle 40.

In the presently shown preferred embodiment, the side edges 52 within the central, straight portions 54 extend—in side view—exactly straight and in parallel to the lamp axis X. For purposes of defining a suitable tolerance, the side edges may, in side view, show a certain, limited inclination relative to the lamp axis X. Such an inclination may be defined between the start of the straight portion 54 proximate to the first end 42 of the baffle 40 at the coordinate a (in the example shown as 2 mm) along the lamp axis X as a first measuring point, and a second measuring point defined at a fixed distance b of 5 mm along the lamp axis X. While in the example shown the straight portions 54 show no inclination between the two measuring points, there may be conceivable embodiments, or simply manufacturing tolerances, where a slight inclination of the side edges 48 between the above defined measuring points at coordinates a, b is equal to or below a defined tolerance of 0.2 mm, preferably 0.1 mm.

The straight portions 54 of the side edges 48 are arranged at an edge height $H_E$ of 3.3 mm above the bottom surface 41. The tub-shaped baffle 44 thus has a considerably increased height as compared to some prior designs. As shown in FIG. 3, in the preferred embodiment shown the attachment tab height $H_T$ is less than the edge height $H_E$.

The second filament 36 is arranged with its filament axis 37 below the straight portions 54 of the edges 48. A distance $D_2$ between the filament axis 37 of the second filament 36 and a plane defined by the straight portions 54 of the edges 48 is 0.3 mm.

The first filament 34 is arranged partially above and partially below the edge height $H_E$. An upper edge 53 of the first filament 34 is 0.5 mm above the plane of the straight portions 54 of the edges 48.

As shown in FIGS. 3 and 4, the axial length $L_1$ of the first filament 34 almost completely overlaps with the axial length $L_E$ of the straight portions 54 of the side edges 48. Thus, a substantial portion of light emitted from the first filament 34 is shielded at the straight portions 54 rather than at inclined portions of the edges 48, leading to a corresponding straight bright/dark cutoff.

In operation of the lamp 10, if a voltage is applied to either the first filament 34 or the second filament 36, i.e. between the first holding wire 30*a* and the third holding wire 30*c*, and between the second holding wire 30*b* and the third holding wire 30*c*, the filaments 34, 36 operate to emit light. Light emitted from the second filament 36 extends freely in all radial directions, whereas light emitted from the first filament 34 is partially shaded by the baffle 40 as described, in particular at the side edges 48.

FIG. 5 shows schematically a headlight 50 where the lamp 10 as described above is schematically shown arranged within a reflector 46. Light emitted from the filaments 34, 36 (not shown in FIG. 3) is reflected by the reflector 46 to form different illumination beams. Light from the second (high-beam) filament 36 is shown as a dotted line to be reflected by both the upper and lower part of the reflector 46 to form a high-beam without a bright/dark cutoff.

Light emitted from the first low-beam filament 34 is shown as a dashed line to be partially shielded by the baffle 40 such that only an upper portion of the reflector 46 is illuminated. The upper portion of reflector 46 is shaped to reflect the light from the first filament 34 to form an illumination beam with a horizontal bright/dark cutoff.

Arrangement of the filaments 34, 36 and of the baffle 40 is exactly symmetrical with regard to the symmetry plane defined by the axes R, X. Thus, the resulting beam patterns are symmetrical, too. In particular, the low-beam pattern will have a horizontal bright/dark cutoff.

While the invention has been illustrated and described in detail in the drawings and foregoing description, such illustration and description are to be considered illustrative or exemplary and not restrictive; the invention is not limited to the disclosed embodiment.

Variations from the disclosed embodiments can be understood and effected by those skilled in the art in practicing the claimed invention, from a study of the drawings, the disclosure and the appended claims. In the claims the word "comprising" does not exclude other elements, and the indefinite articles "a" or "an" do not exclude a plurality.

The mere fact that certain measures are recited in mutually different dependent claims does not indicate that a combination of these measures cannot be used to advantage. Any reference signs in the claims should not be construed as limiting the scope.

The invention claimed is:

1. Lamp for automotive vehicle front lighting, comprising a base for mechanical and electrical connection to an automotive headlight, said base having a longitudinal axis, a burner fixed to said base, said burner comprising an enclosed transparent vessel, at least a first and a second filament arranged within said vessel, and a baffle arranged proximate to said first filament to partially shield light emitted from said first filament, wherein said baffle is of concave shape and includes at least a bottom surface and side surfaces, said side surfaces terminating in side edges, and wherein said baffle further includes a front surface arranged at an axial front end of said baffle, the axial front end being the axial end of said baffle closest to the second filament, where at least a part of said front surface is arranged between said first and second filaments to shield said second filament from light emitted from said first filament, wherein the front surface extends higher than the side edges of the baffle, and wherein the front surface and the side edges form a sloping transition, wherein said side edges each comprise a central portion extending, in a side view, at least straight and in parallel to said longitudinal axis, said straight central portions starting, in a side view, at a distance (a) along said longitudinal axis from said front end of no more than 2.8 mm, and wherein an edge height is defined as a distance between said bottom surface and a plane defined between said straight central portions of said side edges, where said edge height is more than 2.8 mm.

2. Lamp according to claim 1, where said straight central portions of said side edges start, in side view, at a distance parallel to said longitudinal axis within an axial range of 1.4-2.8 mm from said front end of said baffle.

3. Lamp according to claim 2, where said straight central portions start within an axial range of 1.7-2.5 mm from said first end.

4. Lamp according to claim 1, where said straight central portions extend, in side view, straight and in parallel to said longitudinal axis over an axial length of at least 3.5 mm.

5. Lamp according to claim 1, where said baffle comprises, at a back end located opposite to said front end, a flat attachment member oriented in parallel to said bottom surface, where said attachment member is arranged in a plane distant from a plane of said bottom surface by an attachment member height, where said attachment member height is less than said edge height.

6. Lamp according to claim 1, where said front surface extends up to a front height defined as a distance from said bottom surface, where said front height is more than 3.5 mm.

7. Lamp according to claim 1, where said first filament is provided as a winding structure around a first filament axis which is oriented in parallel to said longitudinal axis, where a first filament distance is defined as a distance between an upper edge of said first filament and said plane defined by said straight central portions of said side edges, where said first filament distance is less than 0.75 mm.

8. Lamp according to claim 1, where said first filament extends over a first axial filament length parallel to said longitudinal axis, where said straight central portions of said side edges are arranged over at least 70% of said first axial filament length.

9. Lamp according to claim 1, where said second filament is provided as a winding structure around a second filament axis which is oriented in parallel to said longitudinal axis, where a second filament height is defined as a distance between said second filament axis and said plane of said bottom surface of said baffle, where said second filament height is less than said edge height.

10. Lamp according to claim 1, where said base comprises a reference protrusion defining a radial reference direction, where said filaments and said baffle are symmetrical to a symmetry plane defined by said longitudinal axis and said radial reference direction.

11. Vehicle headlight comprising a reflector, and a lamp according to claim 1.

* * * * *